US005954290A

United States Patent [19]

Rodriguez et al.

[11] Patent Number: 5,954,290

[45] Date of Patent: Sep. 21, 1999

[54] CONTINUOUS WEB MATERIAL TURN UP SYSTEM AND METHOD

[75] Inventors: Peter A. Rodriguez; Robert M. Lincoln, both of Jacksonville, Fla.

[73] Assignee: Sandar Industries, Inc., Atlantic Beach, Fla.

[21] Appl. No.: 08/934,557

[22] Filed: Sep. 22, 1997

[51] Int. Cl.[6] ..... B65H 18/16; B65H 19/20

[52] U.S. Cl. ..... 242/526.2; 242/542.3

[58] Field of Search ..... 242/526.2, 541, 242/542.3

[56] References Cited

U.S. PATENT DOCUMENTS

| | | | |
|---|---|---|---|
| 2,343,047 | 2/1944 | Doyle et al. | 242/526.2 |
| 3,096,947 | 7/1963 | Jacobs et al. | 242/526.2 |
| 4,414,258 | 11/1983 | Corbin | 242/526.2 |
| 4,659,029 | 4/1987 | Rodriguez | 242/526.2 |
| 4,783,018 | 11/1988 | Rodriquez | 242/526.2 |
| 4,964,584 | 10/1990 | Taipale et al. | 242/526.2 |

FOREIGN PATENT DOCUMENTS

| | | | |
|---|---|---|---|
| 350133 | 1/1990 | European Pat. Off. . | |
| 634174 | 8/1936 | Germany | 242/526.2 |

*Primary Examiner*—John M. Jillions
*Attorney, Agent, or Firm*—Arthur G. Yeager

[57] ABSTRACT

An apparatus and method for cutting a travelling paper winding on a spool and transferring the web onto an empty spool including a cutting tape passing through an elongated guideway from a near end to a far end; the apparatus and method characterized by attaching a releasable mechanical fastener element to the forward end of the cutting tape and another cooperating releasable mechanical fastener element to the far end of an empty spool and directing the fastener onto the cutting tape to the far end of the empty spool for engagement with -the fastener element on the spool to attach the cutting tape to the empty spool.

8 Claims, 4 Drawing Sheets

CONTINUOUS WEB MATERIAL TURN UP SYSTEM AND METHOD

BACKGROUND OF THE INVENTION

1. Field of the Invention

This invention relates to an apparatus and method for cutting a travelling web of paper being wound on one spool and transferring the web to an empty spool while the web is travelling.

2. Prior Art

It is a general practice in the paper industry to produce a continuous sheet or web of paper which is wound onto spools.

In order to have a continuous operation it is, of course, necessary to have a system for instantaneously switching from winding the web of paper onto a full roll to an empty spool, particularly at modern speeds of paper production. In the prior art there are methods of feeding a tape onto the rotating empty spool core and causing it to be spirally wrapped on that spool core as it stretches tight across the travelling web of paper and cuts the paper, with the cut edge being led onto the empty spool supported by the cutting tape. Subsequent improvements have dealt with methods of stringing the tape for cutting and feeding, and the use of various types of tapes. U.S. Pat. No. 4,414,258 described a tape made of repulpable paper woven into a tape. See also U.S. Pat. Nos. 4,659,029 and 4,783,018 for other tapes and improvements in turn up systems. Improvements are still needed however, to deal with the issues of thermal breakdown of the adhesive used on the cutting tape as well as the need to provide a cutting tape in very dusty environments such as tissue mills where the dust can eliminate the ability to use an exposed adhesive. None of the means or methods of the prior art provides the needed mechanical device and method to overcome the limitations of the prior art.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

SUMMARY OF THE INVENTION

Figure 1:
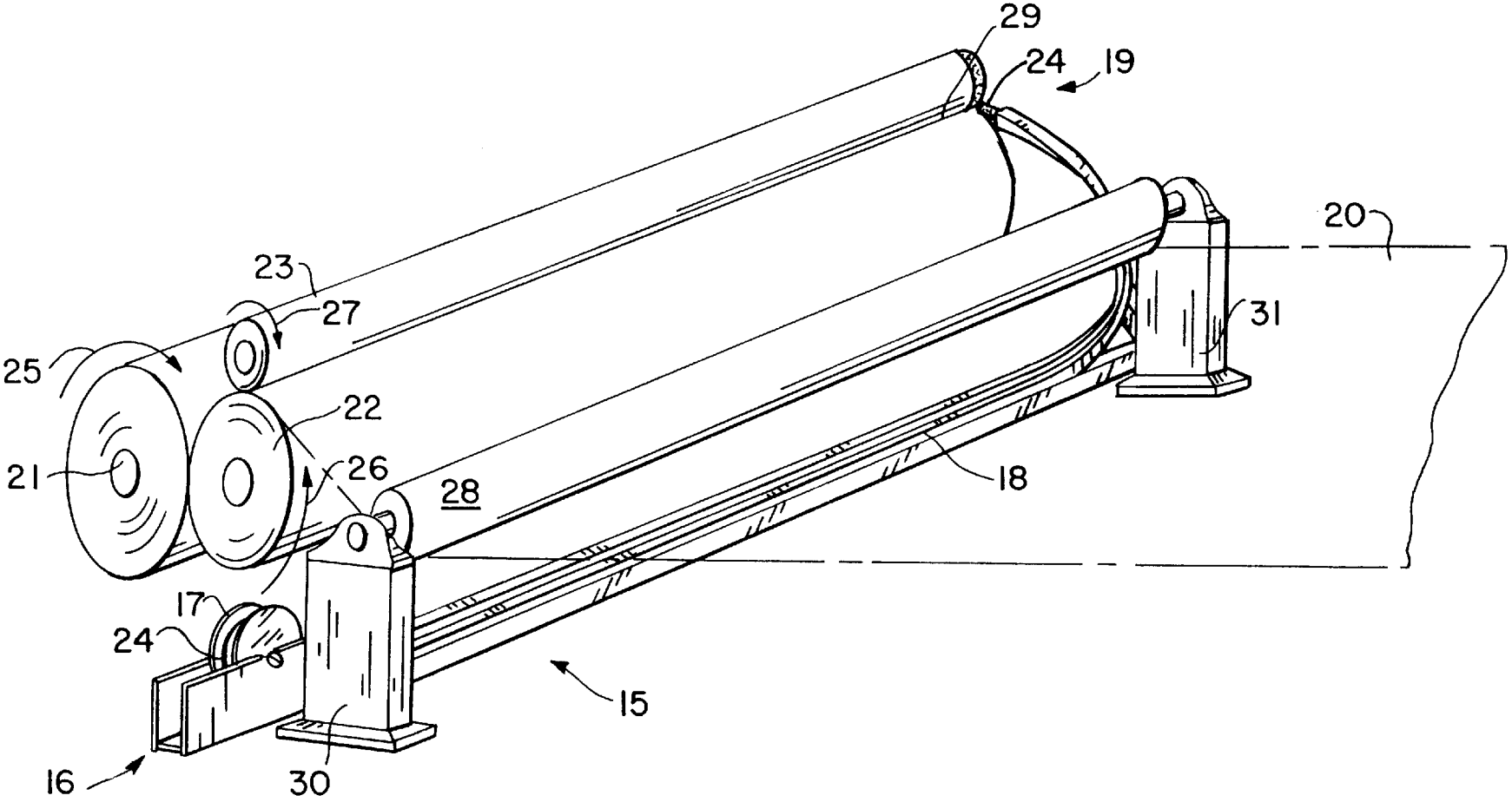
FIG. 1 is a perspective view of the system of rollers employed in the paper industry to wind the paper web onto rolls, and the present apparatus used to transfer the leading edge of the web to an empty spool in accord with this invention.

In one aspect of the present invention, there is provided an apparatus for cutting with a tape a travelling web of paper being wound on a first spool and transferring that travelling web onto an empty spool that is driven by a roller by attaching the tape to the empty spool in a nip between the empty spool and the roller, and a cutting tape is moved beneath and extends beyond the side edges of the web of paper. The improvement includes a mechanical linking means located between the empty spool and the tape for attaching the tape to the empty spool. Other aspects of the present invention are seen wherein the tape has an upper and a lower flat surface and the mechanical linking means includes a pair of cooperating releasable fasteners with one fastener being attached to the cutting tape on one of the flat surfaces and another fastener being attached to the empty spool beyond one edge of said web. The one fastener is attached to one surface of the cutting tape at its forward end before being moved beneath the web of paper. The one fastener covers only a central lengthwise end portion of one surface of the cutting tape. Other features of the improvements include the one fastener being attached to one surface of the cutting tape at its forward end and the other fastener being attached substantially around a circumference of the empty spool beyond the one edge of the web. The improvement further includes spacer means attached between the other fastener and a circumferential surface of the empty spool to elevate the other fastener to enhance proper engagement between the first and second fasteners in a nip between the empty spool and the roller driving the empty spool. The one fastener is formed of a plurality of interlocking elements and the other fastener is formed of a plurality of interlocking elements.

Additional features are found in the mechanical linking means having first and second cooperating elements. The first element is attached to a surface of cutting tape adjacent the forward end thereof and the second element is attached to the empty spool adjacent an outer end thereof. This arrangement also includes spacer means attached to the empty spool for elevating the second element from a circumferential surface of the empty spool to provide for engagement between the elements in the nip between the empty spool and the roller driving the empty spool.

The improvements also include a guideway having an elongate slot facing upwardly underneath the web and extending beyond the side edges of the web for directing the movement of the cutting tape.

In other aspects of the present invention there is provided an improved method for cutting a travelling web of paper being wound on a spool and transferring the web after cutting to an empty spool. The method includes moving a cutting tape to extend beneath and laterally across the web of paper and beyond side edges thereof and introducing the far end of the tape into the nip of the empty spool and the roller driving that spool to cause the tape automatically to spirally wrap around the empty spool while cutting the web of paper. The improvement includes the steps of: attaching a first cooperating releasable fastener to the tape adjacent its forward end; attaching a second cooperating releasable fastener to the circumferential surface of the empty spool; and feeding the forward end of the tape into the nip for attaching the first and second fasteners together to attach the cutting tape to the empty spool to cut and transfer the web of paper thereto. The first step also includes attaching the first fastener to overlie only a central lengthwise forward portion of one surface of the cutting tape. Additional steps include attaching one interlocking material element to one surface of the cutting tape; and attaching an elongated portion of a second interlocking material substantially a round the outer perimeter surface of the empty spool outwardly of the edge of the web of paper. This last step also includes attaching a spacer element onto and between the surface of the empty spool and the elongated portion of material to elevate same to enhance the engagement between the interlocking elements in the nip between the empty spool and the roller driving the empty spool.

Additional aspects include moving the cutting tape into a guideway which extends substantially the width of the cutting tape with an elongated slot above the guideway adapted to permit the cutting tape to be pulled out laterally from the guideway. There is an elongated undercut recess below the guideway to permit travel of the first cooperating fastener therethrough and the recess being narrower that the guideway and centered on the guideway. The undercut recess has a width greater than the width of the cutting tape. These steps also include automatically attaching a predetermined length of the first fastener to the cutting tape at the forward end thereof prior to travelling through the guideway to adjacent the far end of the empty spool and attaching the first fastener to the cutting tape with pressure sensitive adhesive material.

DETAILED DESCRIPTION AND BEST MODE OF THE INVENTION

The general features of this invention are best seen and understood by reference to FIG. 1 which shows some of the equipment employed in a paper manufacturing plant to wind up the manufactured paper on rolls for storage and use elsewhere. A continuous web of paper 20, shown partially and in dotted line, travels at a relatively rapid rate of speed to a combination of spools upon which the paper is rolled. Paper web 20 advances toward tension roll 28, mounted in journals on supports 30, 31, leading web 20 over driving roll 22 and winding about spool or roll 21 turning in the direction of arrow 25. Driving roll or drum 22 turns in the direction of arrow 26 and is pressed against the paper on winding roll 21 causing it to rotate in the indicated direction. When winding roll 21 has been filled to the desired capacity with paper from web 20, it is necessary to cut web 20 laterally, transfer the cut edge to an empty spool 23, and start the web winding on that spool to eventually produce another filled roll, such as roll 21. Empty spool 23 is positioned generally vertically above the location shown in FIG. 1 until it is ready to accept paper from web 20 and begin winding it up. In order to cause empty spool 23 to begin rotating and to accept the cut edge of web 20, it is necessary to lower spool 23 until it contacts driving roll or drum 22, as shown in FIG. 1, and then to introduce the cut edge of web 20 into the nip 29 between empty spool 23 moving in the direction shown by arrow 27 and driving drum 22 and to cause a transfer of the paper web 20 thereto. Support and/or drive apparatus for members 21, 22 and 23 are not shown for ease of illustration.

The apparatus of this invention is generally indicated by reference numeral 15 which is a means in the form of a dispenser 16 having tape spool 17 for introducing a tape to the far edge area 19 of empty spool 23 and causing that tape to wrap around surface 36 of spool 23 in a spiral fashion, and, in so doing, cut web 20 and cause the cut edge to be introduced onto surface 36 of empty spool 23 and to transfer the cut web 20 to become wrapped about spool 23. Guideway 18 is used to direct the passage of tape 24 to the far edge of area 19 of spool 23. Guideway 18 is more specifically shown and described in U.S. Pat. No. 4,783,018.

Figure 2:
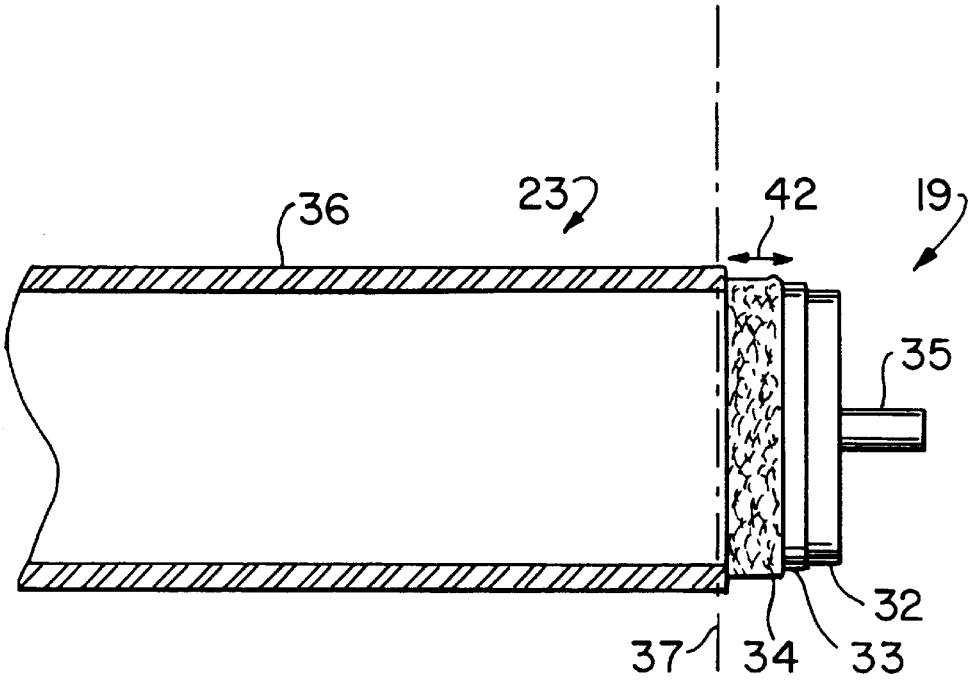
FIG. 2 is a partial elevational view of the far end of an empty spool illustrating spacer and fastener means attached at the far edge thereof in accord with the present invention.

With respect now to FIG. 2, the far edge area 19 includes drive rod 35 the end portion 32 of spool 23 and a spacer core 33 that wraps around the spool 23. Spacer core 33 may be made of, for example, fiberglass or other material and is attached outside of the edge of the web 20 that is shown at trim line 37.

Figure 3:
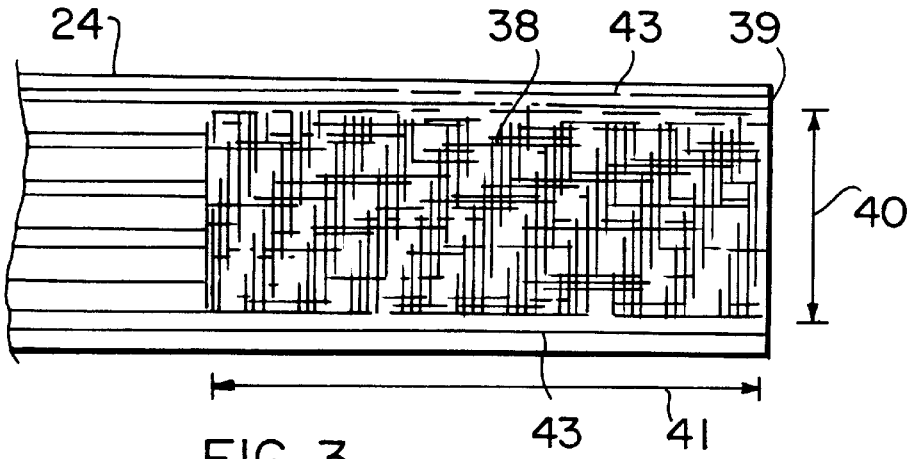
FIG. 3 is a top plan view of the forward end of the cutting tape and a fastener means mounted thereon in accord with the present invention.

Spacer core 33 provides an elevated attachment surface for a circumferential band or ring of Velcro type padding commonly referred to as loop or fluff 34 having a width of about 4" as indicated by line 42 and attached with adhesive as understood in the art. The elevation provided by spacer core 33 is sufficient to provide for proper engagement between the loop portion 34 and the hook portion 38 (FIG. 3). It is understood that the hook and loop portions may be interchanged.

The tape and Velcro type combination is illustrated in FIG. 3. Tape 24 includes a commonly referred to hook portion 38 of Velcro having a length of about 2" as shown at line 41 and a width of about ½" as shown at line 40 and attached to tape 24 with adhesive. The leading edge of the tape 24 hook portion 38 is illustrated at numeral 39.

Tape supplying apparatus 15 may be one of the embodiments of U.S. Pat. Nos. 4,659,029 and 4,783,018 that describe tape handling apparatus as described hereinbelow.

Figure 4:
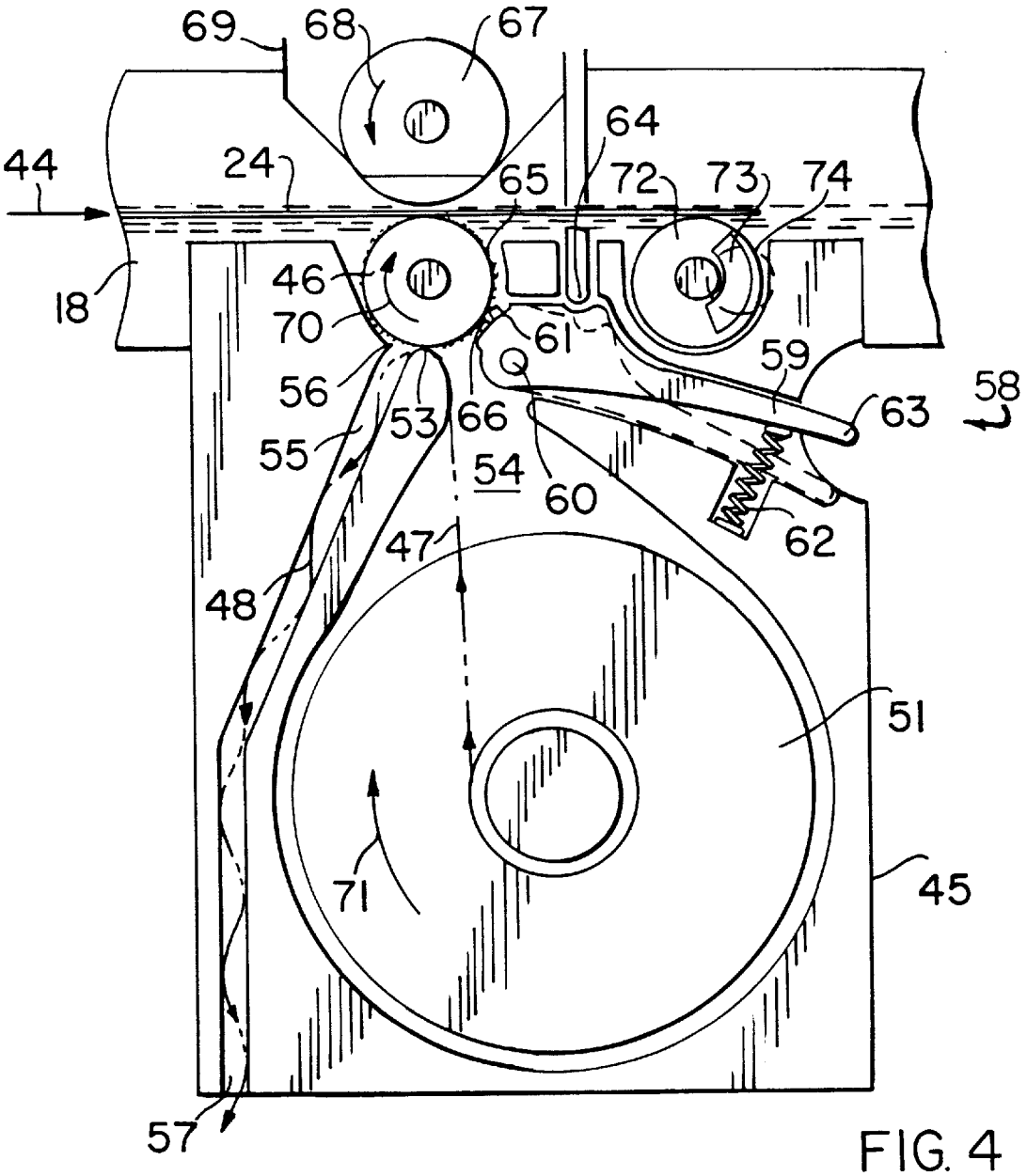
FIG. 4 is a schematic illustration of the preferred method for applying the adhesive-backed fasteners to the cutting tape.
Figure 5:
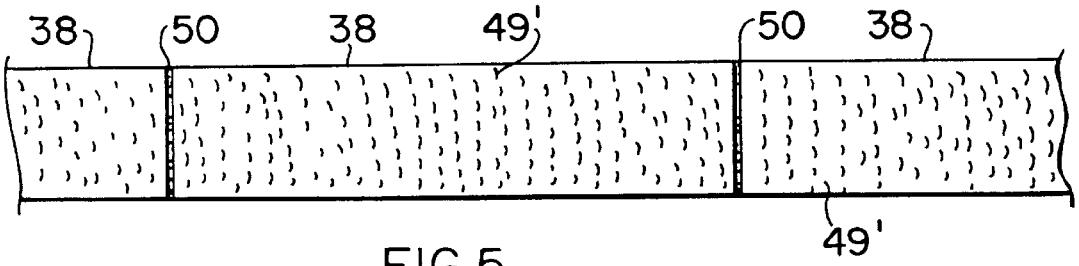
FIG. 5 is a top plan view of the adhesive-backed fastener attached to the cutting tape.
Figure 6:
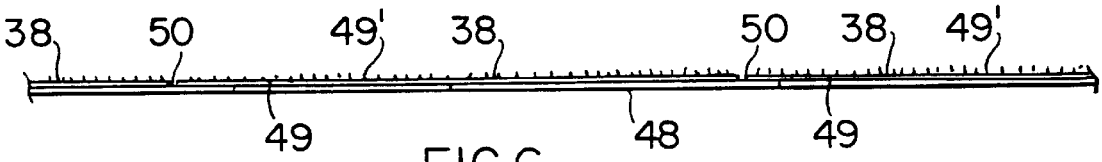
FIG. 6 is a side elevation view of the fastener of FIGS. 4-5.

In FIGS. 4–6 there is shown a horizontal guideway track 18 for guiding a cutting tape 24 from left to right in the direction of arrow 44. As the tape 24 passes by the device of this invention in a cartridge or cassette container 45 it applies a strip of adhesive-backed Velcro hooks 38 to the bottom surface of tape 24 by contact with transfer roller 46. The adhesive is supplied from a composite tape 47 which includes a strip of pressure sensitive adhesive 49 adhered to a layer of strippable backing tape 48. A supply roll 51 of the composite tape 47 feeds tape 47 to transfer roller 46 with contact between tape 47 and roller 46 being made at the tip 53 of a stationary nose built into the container 45. Nose tip 53 separates a first channel 54, leading from supply roll 51 to transfer roller 46 and a second channel 55, leading from transfer roller 46 to a disposal site for backing layer 48. Nose tip 53 is a sharp reverse bend so as to enhance the separation of backing layer 48 from the pressure-sensitive adhesive 49 clinging to transfer roller 46. In order to assure this separation a doctor knife edge 56 is positioned closely adjacent to nose tip 53 and slightly downstream of it. Knife edge 56 is positioned very close to the surface of transfer roller 46 such that the adhesive layer on roller 46 will pass by knife edge 56 but the backing layer 48 will be deflected. Backing layer 48 is stripped away from the adhesive layer 49 on transfer roller 46 and falls into second channel 55 where it eventually, by gravity and/or the force of backing layer 48 pushing on previously stripped backing layer 48, passes through exit port 57 to a waste receptacle or merely hangs downwardly until gathered by an operator for waste disposal. Backing layer 48 is normally a silicone treated paper having poor adherence to the pressure-sensitive adhesive.

A brake mechanism is employed to stop the application of adhesive when desired. The brake mechanism 58 includes a pivotable brake lever 59 having a pivot point 60 and a friction element 61 in the form of teeth 66 to bear against transfer roller 46 so as to prevent it from rotating. The embodiments illustrated are based on a friction element 61, spring biased against transfer roller 46 having lightly gripping Velcro type loop material 65 thereon, but a number of other engaging means may be employed which the hook material 38 contacts.

Spring 62 bears against arm 63 of brake lever 59 so as to bias friction element 61 against roller 46. Thus, at rest, the brake mechanism 58 is spring biased to prevent rotation and prevent application of adhesive to tape 24. In order for the device to operate brake lever 59 must be forced to release friction element 61 from contact with transfer roller 46. This is accomplished in FIG. 4 by the downward movement of plunger 64, which is a part of the paper windup machine to which the device of this invention is attached. Plunger 64 moves up and down as member 69 moves up and down. Pressure roller 67 is also carried by member 69. Pressure roller 67 in its down position bears against the upper surface of cutting tape 24 directly opposed to transfer roller 46, and provides the force to transfer the strip of Velcro from transfer roller 46 to tape 24 by reason of the fact that the adhesive backing on the hook portion 38 sticks much more firmly to tape 24 than the hooks 49' do to the loops 65 on transfer roller 46. By enabling automatic controls the operator may cause the movement of member 69, which normally is up with no contact between pressure roller 67 and tape 24. When the machine is to prepare a length of tape 24 with adhesive-backed hook portions 38 thereon, member 69 automatically moves downwardly to apply the force of pressure roller 67 to tape 24 and to release the brake mechanism 58 by pushing downwardly on brake lever arm 59 so as to disengage friction element 61 from transfer roller 46. The position of brake member 59 and friction element 61 at rest is shown in solid lines in FIG. 4, and when pushed downwardly by plunger 64 to release the brake, their positions are shown in dotted lines.

One step in the operation of using the cutting tape to cut a moving web of paper and to transfer the cut web to a new windup roll is to push the forward end of the cutting tape, with adhesive and hook portion 38 on its bottom surface, across the width of the moving web of paper and have the forward end near to the new windup roll. In order to be sure that the forward end of the tape has a length of hook portion 38 on it, a detector roll 72 is employed on the tape transfer machinery to which the device 45 of this invention is attached. The detector roll 72 is positioned very close to the lower surface of tape 24 which moves by from left to right. Roll 72 has a surface 74 which will, therefore, be moved by the contact with the Velcro hooks 38 on tape 24. This will cause roll 72 to rotate which, in turn, is detected by rotation sensor 73. If roll 72 fails to rotate, sensor 73 will signal a control (not shown) to divert tape 24 away from the track that leads it across the width of the travelling web of paper to the vicinity of the new wind up roll. The operator is signaled with that information so that he may abort the faulty tape 24 and begin a new cycle to apply another hook portion 38 to tape 24 and send it across the web to the new empty wind up spool 23.

The transfer roller 46 has a small portion of its perimeter extending outwardly of container 45 so as to contact the surface of the tape 24 centrally between outer areas 43, as seen in FIG. 3 of tape 24.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an apparatus for cutting with a tape a travelling web of paper being wound on a first spool and transferring that travelling web onto an empty spool being driven by a roller by attaching said tape to said empty spool in a nip between said empty spool and said roller, said cutting tape being moved beneath and extending beyond the side edges of the web of paper; the improvement which comprises mechanical linking means located between said empty spool and said tape for attaching said tape to said empty spool, said empty spool including a cylindrical web carrying portion defined by a diameter and an outer surface and opposite cylindrical end portions, one said cylindrical end portion being defined by a diameter smaller than said diameter of said web carrying portion and an outer surface below said outer surface of said web carrying portion, said tape having an upper and a lower flat surface, said mechanical linking means including a pair of cooperating releasable fasteners, one said fastener being attached to said cutting tape on one of its said flat surfaces, another said fastener being attached to said empty spool beyond one said edge of said web, and a cylindrical spacer core attached around said one end portion of said empty spool and having an outer surface below said outer surface of said web carrying portion, said spacer core being attached between said outer surface of said one end portion of said empty spool and said other fastener to elevate said other fastener to enhance proper engagement between said fasteners in a nip between said empty spool and said roller driving said empty spool.

2. The system of claim 1 wherein said one fastener is attached to said one surface of said cutting tape at its forward end before being moved beneath the web of paper.

3. The system of claim 2 wherein said one fastener covers only a central lengthwise end portion of said one surface of said cutting tape.

4. The system of claim 1 wherein said fastener is formed of a plurality of interlocking elements and said other fastener is formed of a plurality of interlocking elements.

5. The system of claim 1 further including a guideway having an elongated slot facing upwardly underneath said web and extending beyond said side edges of said web for directing the movement of said cutting tape.

6. The system of claim 5, wherein said one fastener covers only a central lengthwise end portion of said one surface of said cutting tape to leave edges of said cutting tape free for ease of movement of said cutting tape in said guideways.

7. In an apparatus for cutting with a tape a travelling web of paper being wound on a first spool and transferring that travelling web onto an empty spool having opposite end portions and a paper carrying portion therebetween being driven by a roller by attaching said tape to said empty spool in a nip between said empty spool and said roller, said cutting tape being moved beneath and extending beyond the side edges of the web of paper; the improvement which comprises mechanical linking means located between said empty spool and said tape for attaching said tape to said empty spool at one said end portion of said empty spool, said tape having an upper and a lower flat surface, said mechanical linking means including a pair of cooperating releasable fasteners, one said fastener being attached to said cutting tape on one of its said flat surfaces, another said fastener being attached to said one end portion of said empty spool outwardly beyond one said edge of said web for wrapping said web around said empty spool between said opposite end portions, said one fastener being attached only to a central lengthwise end portion of said one surface of said cutting tape at its forward end before being moved beneath the web of paper, further including a spacer core attached to said one end portion of said empty spool, said spacer core being mounted and wrapped around a circumferential surface of said empty spool at said one end portion to elevate said other fastener when attached thereto to enhance proper engagement between said fasteners in a nip between said empty spool and said roller driving said empty spool.

8. The system of claim 7 wherein said other fastener is attached substantially around a circumference of said spacer core.

* * * * *